US005829592A

United States Patent [19]

Henry, Jr. et al.

[11] Patent Number: 5,829,592

[45] Date of Patent: Nov. 3, 1998

[54] END CAPS

[75] Inventors: Douglass C. Henry, Jr., Newmanstown; Jerry D. Beard, Harleysville, both of Pa.

[73] Assignee: Henry Molded Products Inc., Lebanon, Pa.

[21] Appl. No.: 821,620

[22] Filed: Mar. 24, 1997

[51] Int. Cl.[6] ..... B65D 85/672

[52] U.S. Cl. ..... 206/416; 206/389; 206/586

[58] Field of Search ..... 206/389, 391, 206/394, 397, 413–416, 386, 509, 511, 597, 498, 585, 586

[56] References Cited

U.S. PATENT DOCUMENTS

| | | | |
|---|---|---|---|
| 3,375,919 | 4/1968 | Schlager et al. | 206/392 |
| 3,726,396 | 4/1973 | Birkner | 206/415 |
| 3,762,626 | 10/1973 | Dorsey | 206/586 |
| 4,457,429 | 7/1984 | Huber et al. | 206/394 |
| 4,580,680 | 4/1986 | Wind | 206/392 |
| 4,944,398 | 7/1990 | Gatt | 206/564 |
| 5,337,895 | 8/1994 | Mitelman et al. | 206/416 |
| 5,346,065 | 9/1994 | Dunbar et al. | 206/391 |
| 5,368,671 | 11/1994 | Sashihara et al. | 206/416 |

*Primary Examiner*—Paul T. Sewell
*Assistant Examiner*—Luan K. Bui

[57] ABSTRACT

This invention relates to end caps for supporting cylindrical rolls of material with the axes of the rolls extending vertically. The end caps are formed in one piece of molded pulp to secure and protect the rolls during shipment.

7 Claims, 5 Drawing Sheets

4
4
10
11
12
14
15
16
18
24
25
26
30
32
34
35
36
38
39
40
46
48
50

END CAPS

FIELD OF INVENTION

This invention relates to molded end caps for use in supporting and protectively packaging rolls for shipment with the axes of the rolls extending vertically.

On Mar. 25, 1996, Provisional Application Ser. No. 60/014,020 was filed. The filing date of such application is claimed for this complete application.

BACKGROUND OF INVENTION

Material such as stretch wrap, foil, paper and the like for commercial use is commonly formed into cylindrical rolls where the material is wrapped around a tubular roll core. When rolls are shipped from a material manufacturer to an end user, the rolls need to be protected from damage in transit. The rolls have to be spaced from each other when shipped and securely held in place so that the material is not damaged by vibrations and bumps from the truck or other transport vehicle.

If a roll of material is placed horizontally on a supporting surface engaged by the periphery of the roll, with some materials and roll sizes flat depressions may result during transport. If a roll shifts during shipment, the edges of the material at the ends of the roll may be damaged.

Roll supports have been provided made of plastic material such as polystyrene. Supports have been made of hard plastics which will support a roll suspended out of contact with other rolls in a package. Roll supports made of plastic present disposal problem for the end user of the roll product. When the material in the roll is used in large quantities, the user ends up with a pile of roll support material. Plastic if burned can give off toxic smoke. If placed in a landfill, the plastic is relatively non-biodegradable. Some landfills object to receiving such material.

Molded paper pulp is a desirable material for use in shipping roll goods. Pulp is environmentally friendly and it is easy to dispose of after use. However, molded pulp is relatively flexible compared to other materials. When used in a package weighing hundreds of pounds, the molded pulp must be designed to give it added rigidity so that the pulp has sufficient strength to withstand roll support loads.

Manufacturers of certain roll material desire to ship their rolls with the axes of the rolls extending vertically, not horizontally, for greater stability and protection of the roll material. Roll supports need to be provided which will hold material on a vertical roll core from shifting axially downwardly on the core. Each roll needs to be stabilized and held at an upper end as well as a lower end so that the roll does not move during transit. Further, it is desirable to provide end supports for each roll in a group of rolls on a pallet and having multiple tiers, the entire package being banded together and formed into a single unit for shipment of a multiple number of rolls.

One object of this invention is to provide molded pulp end caps for supporting cylindrical rolls of material, each roll having a tubular core with the axis of the roll vertical, a bottom and top end cap being provided for each roll constructed according to this invention.

Another object of this invention is to provide an end cap having an outside wall formed with depressions which create a raised inside wall which engages the adjacent inner end of the material in the roll to be supported, the roll core receiving a central plug on the cap to position the roll relative to the cap, and a collar being provided around the edge of the cap to form a chamber with the plug to receive and protect an adjacent roll end.

Another object of this invention is to provide end caps whereby an upper roll may be mounted on top of a lower roll with the lower end cap of the upper roll seated against and the top of an end cap on the upper end of a lower roll and the end caps being provided with depressions whereby a group of rolls may be banded together in a single package by straps extending around the caps and rolls.

A further object of this invention is to provide end caps having depressions formed so that the straps extending across an end cap are within the depressions for part of their extension and outside the depressions and against the end cap outside walls for the remainder of their extension to facilitate automatic assembly of a package without the straps being caught on conveyors.

A still further object of this invention is to provide end caps formed with a flat wall support having a central plug and outside collar made in a one-piece molded construction to receive and support a cylindrical roll.

Other objects of this invention will become apparent hereinafter from the specification and from the recital in the appended claims.

DRAWINGS

DESCRIPTION

Figures 1, 2:
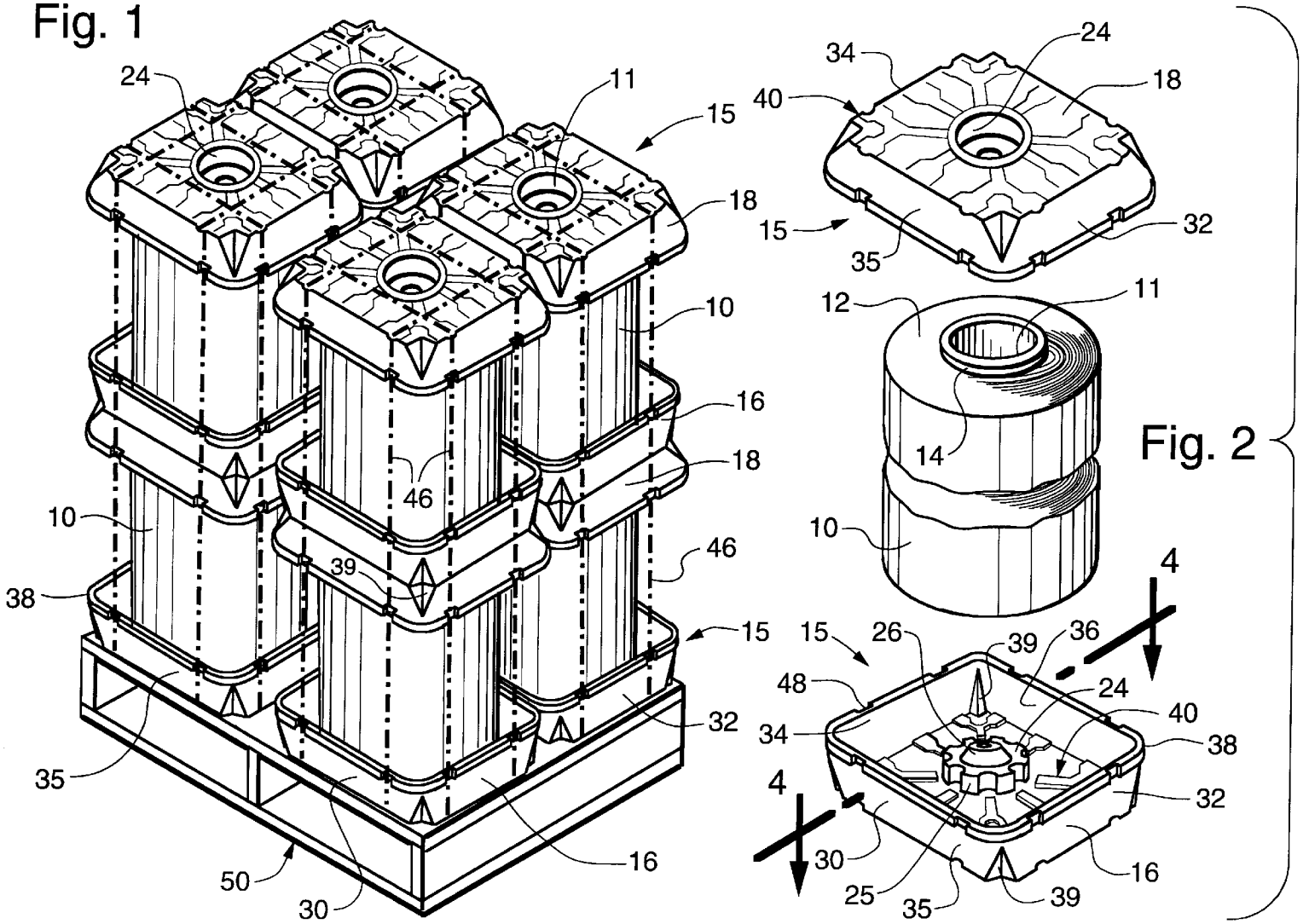
FIG. 1 is a prospective view of an eight-roll package, a lower tier of four rolls supporting an upper tier of four rolls, lower and upper end caps being employed on each of the rolls constructed according to this invention and the package being strapped together on a pallet.
FIG. 2 is an exploded perspective view of a single roll and the two end caps therefor.
Figure 3:
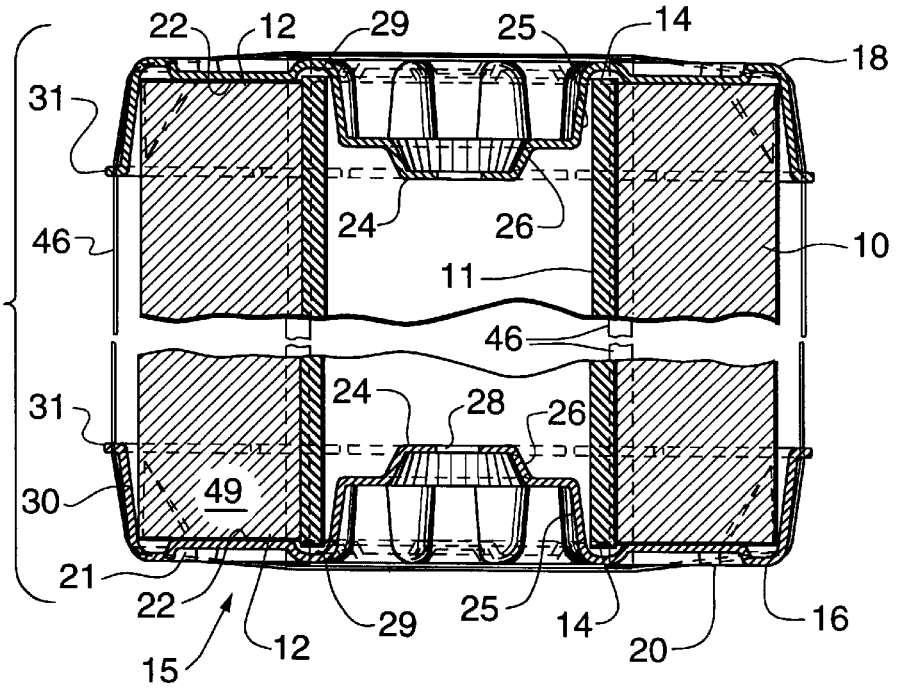
FIG. 3 is a vertical cross-section of a roll broken in the middle and showing the end caps for the roll and the relationship of the caps to the roll end.

Referring now to the drawings by numerals of reference, and first to FIGS. 1–3, 10 is roll of sheet material wrapped around a tubular core 11 of uniform diameter from end to end. The material on the core forms a roll cylindrical in shape. The roll has flat ends 12. In manufacturing a roll of material, a core length is usually employed slightly longer than the width of the material wrapped around it whereby the ends 14 of the core project beyond the ends 12 of roll 11.

To support a group of rolls in a package, with the axes of the rolls extending vertically, end caps 15 are provided. For each roll there is a bottom cap 16 and a top cap 18, both of the same construction. Each end cap is molded in a single piece or sheet of paper pulp formed into a desired shape. Although the molded product will vary somewhat in thickness in the molding process, the cap is generally of uniform thickness.

Cap 15 has an outside wall 20 with a pattern of depressions 21 which produce a raised inside wall 22. In the center of the cap an integral plug 24 is formed which projects away from the inside wall 22. Plug 24 is a truncated cone, the tapered outside wall 25 of which is gear-shaped for strength, see FIGS. 2 and 5. The plug has a dome 26 and a center opening 28. Around plug 24 is an annular recess 29 formed to extend below inside wall 22 of the cap.

Figure 4:
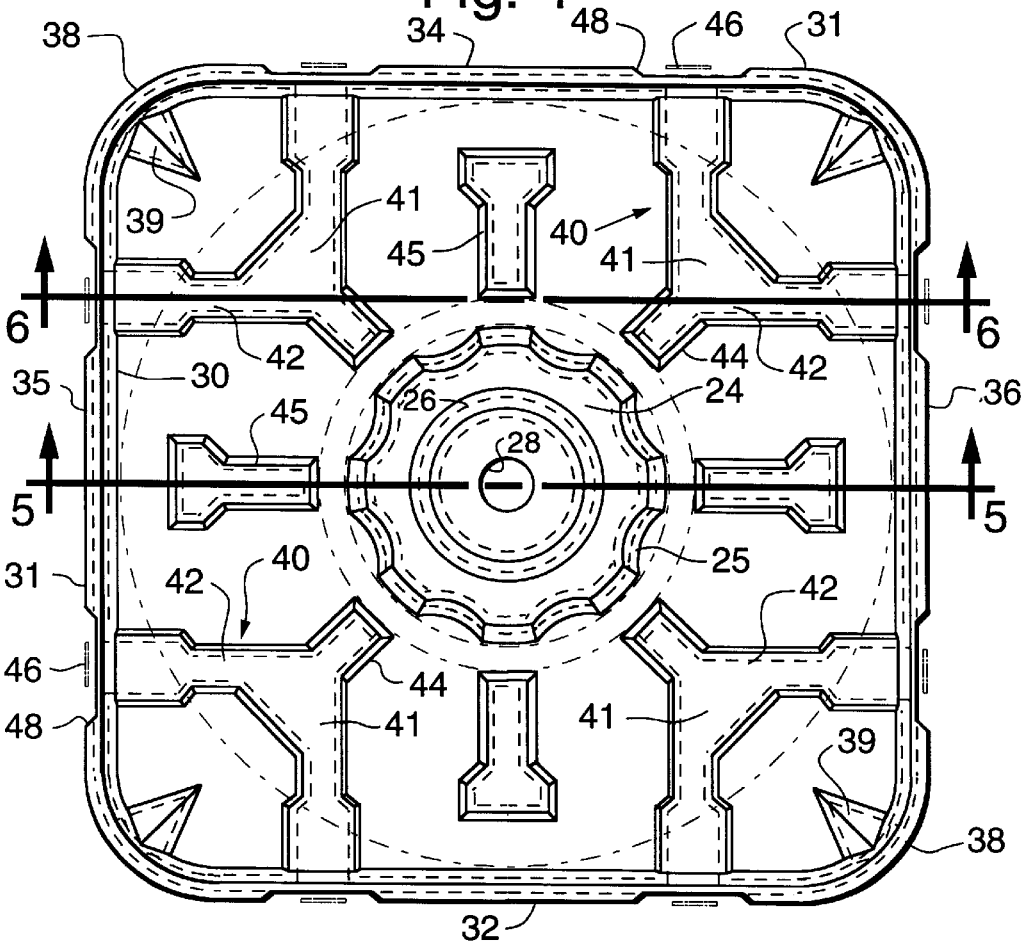
FIG. 4 is a plan view of the inside of an end cap indicated by the lines 4—4 of FIG. 2.

Each end cap 15 is square in configuration, see FIG. 4. Surrounding the cap is a collar 30 which extends away from inside wall 22 and flares outwardly. The projection of collar 30 is similar to the extension of plug 24, FIG. 3. At the edge of the collar remote from wall 22 the collar is formed with an outwardly projecting flange 31. Collar 30 has a first pair of parallel walls 32–34 and a second pair of walls 35–36 parallel to each other and perpendicular to walls 32–34. The respective collar walls are connected to each other by rounded corners 38. Each corner 38 is provided with a triangular depression 39 which forms a strengthening rib at the corner of the end cap.

The depressions 21 in outside wall 20 which forms the inside wall 22 provide a pattern as shown in FIG. 4. There are four Y-shaped areas 40 each having legs 41–42 at right angles to each other and extending from collar 30. Legs 41 and 42 are in planes outside of plug 24. At the point where the legs meet, there is a leg 44 in a radial plane through the center of plug 24. The roll support areas 40 are ninety degrees apart and located at the corners of the end cap 15. Between the corner areas 40, there are T-shaped pads 45 wider at their outer ends and narrower at the ends towards plug 24.

The end cap depressions 21 which form the legs 41 and 42 do not extend all the way across the end cap. Each leg 41 of a Y area is in the same plane as the corresponding leg of an adjacent corner. Likewise, the legs 42 are in the same plane as legs 42 in an adjacent corner.

The width of the depressions 21 which form the legs 41 and 42 of each Y-shaped area is such that straps 46 may be passed around the end caps and across each other. The flange 31 of collar 30 around the end cap is notched at 48 to receive the wrapping straps.

Figure 5:
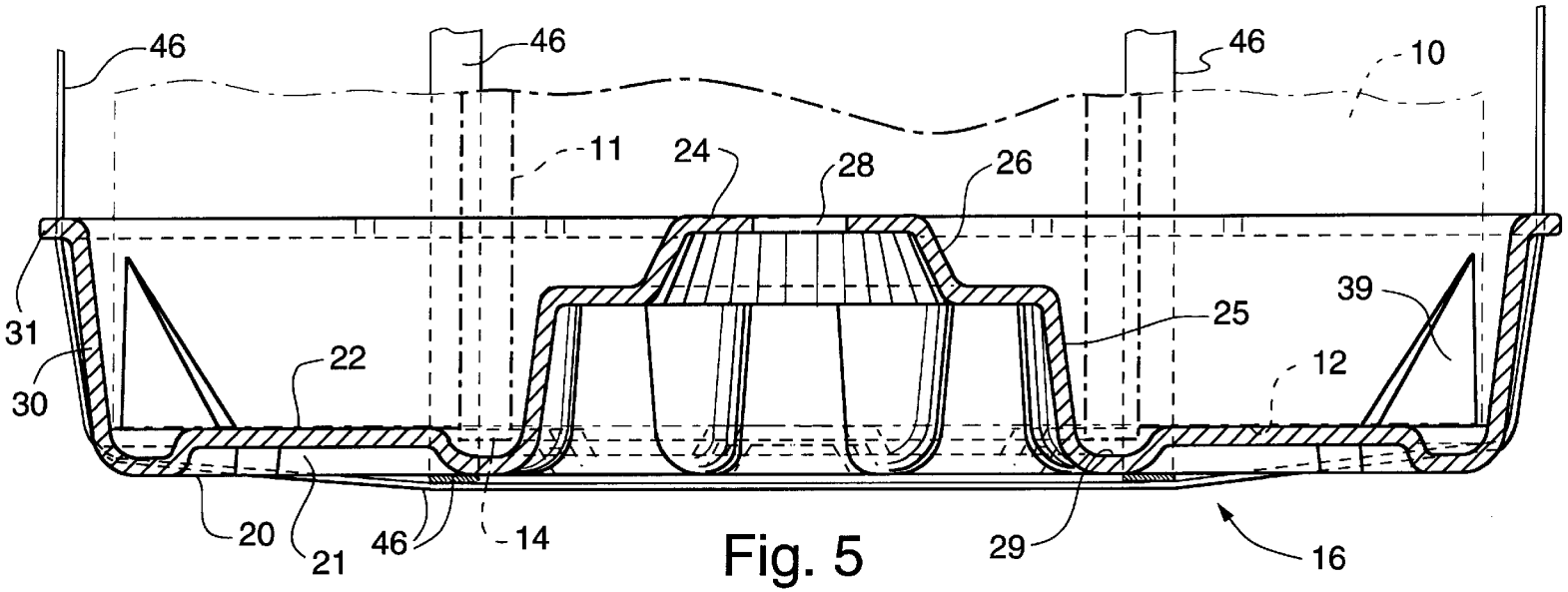
FIG. 5 is an enlarged cross-section through a cap taken on the line 5—5 of FIG. 4.
Figure 6:
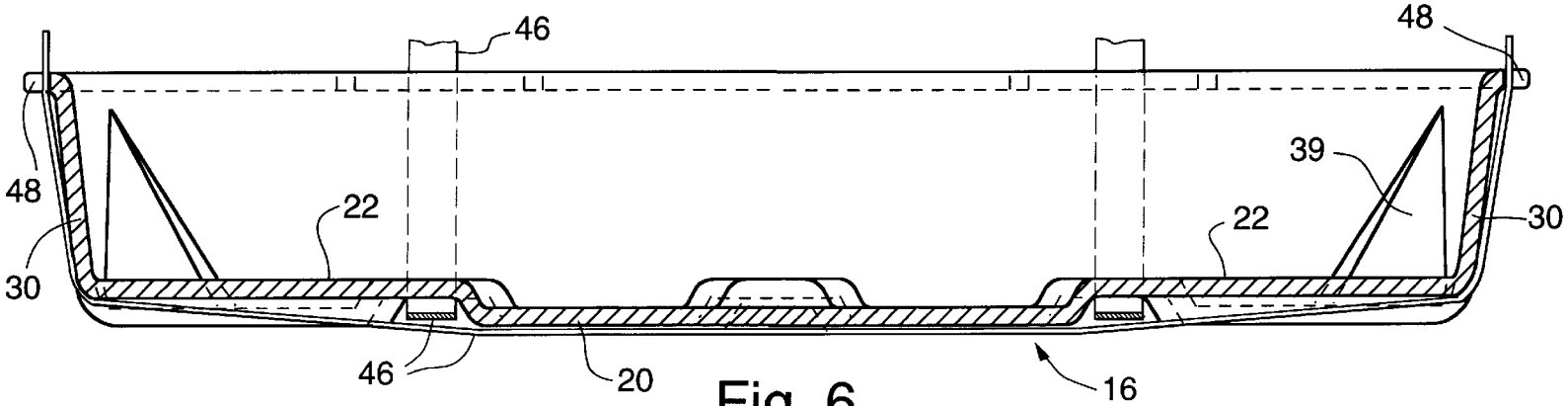
FIG. 6 is an enlarged cross-section taken on line 6-6 through a banding strap location and showing the strap within the cap at its ends and outside the depressions formed in the cap in the middle of its extension.

As shown in FIGS. 5 and 6, when a strap 46 is extended through notch 48 in collar 30 and along its outside wall 35 across the outside wall 20 of the end cap and then along the outside of collar wall 36 and through its notch 48 the strap is within depressions 21 for part of its extension and outside the depressions in the area beneath plug 24. This strap extension around the cap helps to keep the strap from becoming caught on the cap or on mechanical equipment used to automatically form a stack of rolls.

In use, there is a bottom end cap 16 and a top end cap 18 for each roll. In assembly, a roll 10 is placed on bottom end cap 16. The tapered conical plug 24 is of such diameter that it fits snugly into the adjacent end of core 11. If core 11 extends beyond the flat end 12 of roll 10 such projection 14 fits into the annular groove around plug 24. The flat end 12 of roll 10 seats against inside wall 22 of the end cap. The outwardly flaring collar 30 of the end cap spaces the collar from the periphery of roll 10. Plug 24 and collar 30 form a chamber 49 into which the adjacent end of roll 10 projects. The strengthening ribs 39 at the corners of the end cap form edges which are also spaced from the outer surface of the roll.

Plug 24 of the bottom end cap 16 faces upwardly into the core 11 of roll 10. When the top cap 18 is fitted onto the upper end of roll 10 the plug 24 projects downwardly into core 11. The inner wall of top cap 18 seats against the top flat surface 12 of the roll. The relationship of the top cap to roll 10 is the same as the bottom cap 16, except it has its outer side up.

If only a single roll of material is to be packaged, straps 46 can be extended around the two caps 16 and 18 to thereby securely attach the caps to roll 10 and to each other.

A package of rolls can be formed on a pallet 50 as shown in FIG. 1. In that package, four rolls are arranged in a lower tier on the pallet. The lower end cap 16 rests on and are supported by the pallet. The upper end caps 18 facing downwardly and provide supports for the upper or second tier of rolls. The bottoms of the lower end caps 16 on the upper tier seat on the outer walls 20 of the upper end caps 18. The weight of the upper tier is supported on the top end caps of the lower tier. Straps 46 shown in dotted lines in FIG. 1 may be extended around the eight rolls in the stack to thereby secure the end caps to each other and to the other rolls in a completed stack.

When a stack is shipped on a truck or other transport, the rolls are held out of engagement with each other in transit. A stable structure is provided for the second tier of rolls on top of the lower tier. The square configuration of the end caps provides support for the rolls on top of each other.

When the stack reaches its destination where the rolls are to be used in wrapping operations, the straps and end caps are removed from the rolls. The end caps can be recycled for use again by nesting them together. Because of the flared collars on the ends of the caps, the end caps can be fitted one inside the other. Or, if it is desired to dispose of the end caps they can be placed with other paper products, reprocessed again, or burned, or placed in a landfill. Being of molded pulp, the ends are more environmentally friendly than roll supports of plastic or other materials.

Figure 7:
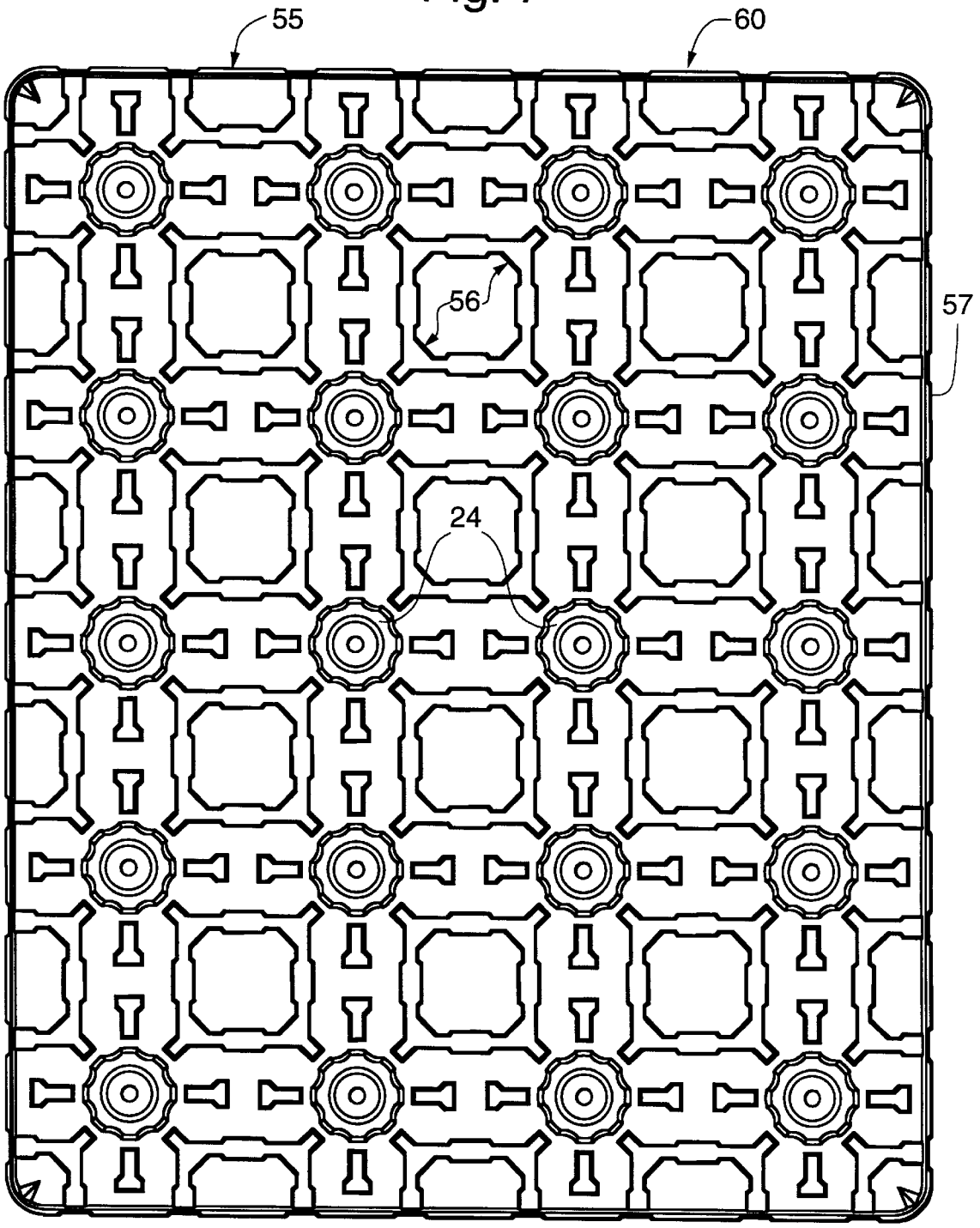
FIG. 7 is a plan view of a single sheet of twenty interconnected end caps, a collar being provided only around the outside of the outer edge of the entire sheet and having strip receiving notches formed in the collar aligned with depressions in the individual end caps for banding.
Figure 8:
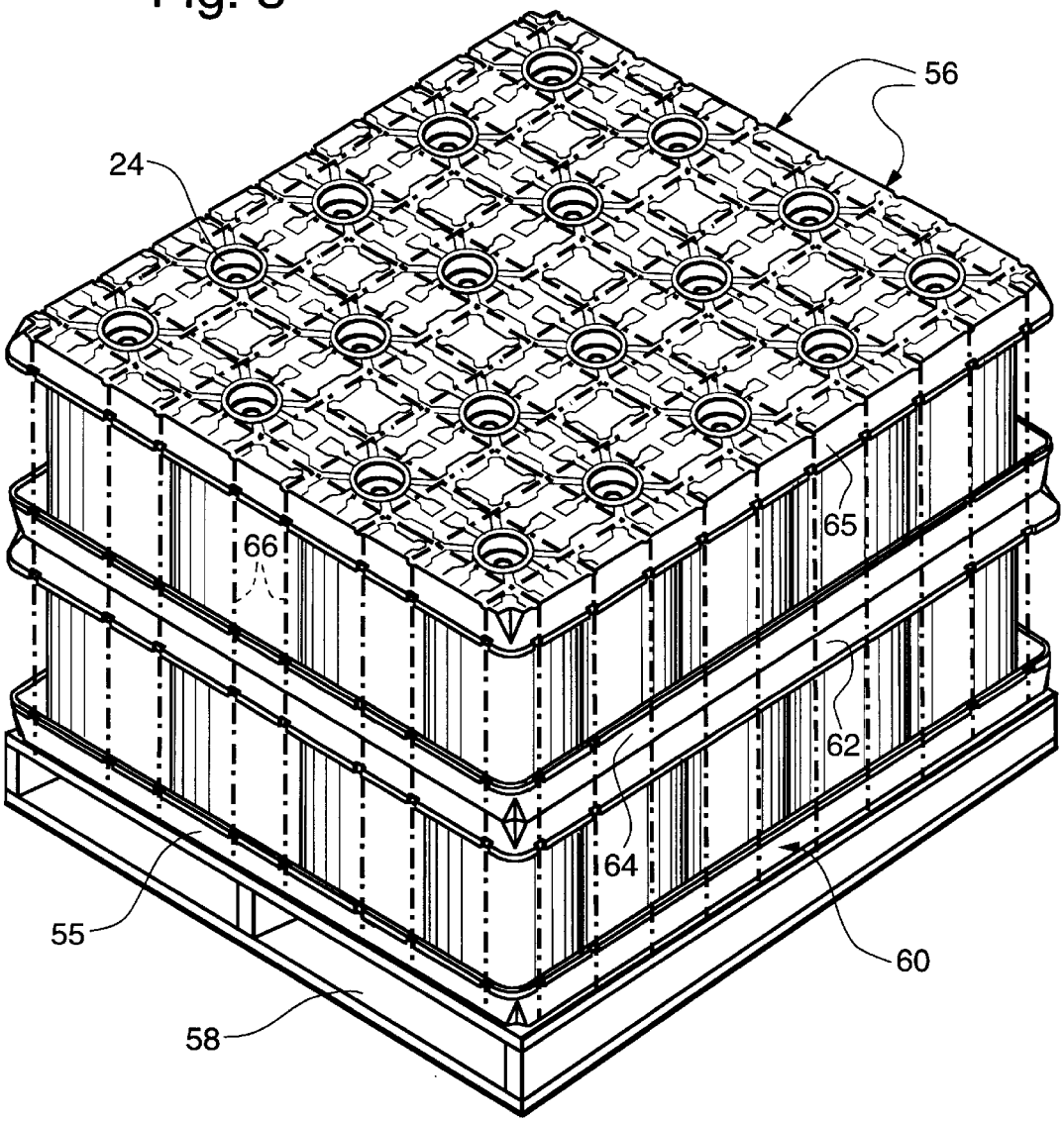
FIG. 8 is a perspective view of a forty roll two tiers stack having end cap support sheets as shown in FIG. 7.

FIGS. 7 and 8 show a further embodiment of the invention where the end caps are interconnected to each other in a single unitary sheet, each end cap segment 56 is of the same construction in plan as end cap 15. A single collar 57 is provided around the entire sheet of end caps.

When a stack is to be formed as shown in FIG. 8, a sheet 60 is placed on a pallet 58 of the same size as the sheet. Rolls 10 are placed on each of the end cap plugs forming a group of twenty rolls in a rectangular configuration four wide and five long. Then a top sheet 62 is provided which is of the same construction as the bottom sheet 60. Sheet 62 is positioned with its plugs projecting downwardly into the rolls on the lower tier. A second tier of rolls is formed by providing a bottom sheet 64 placed on top of sheet 62. The bottoms of the individual caps rest upon corresponding surfaces on the sheet 62. Rolls are then placed on top of sheet 64 to form a second tier of rolls whereupon a sheet 65 is placed on top of the stack to provide a cover.

With the two tiers of twenty rolls each mounted one on top of the other on the pallet 58 and each tier having a bottom sheet and a top sheet, the entire package is wrapped with banding straps 66 to form a completed package.

When a single sheet is to be employed, the number of interconnected end caps can be varied as desired depending on the total number of rolls to be provided in a package and the size of the pallet to be employed.

While this invention has been described in connection with a particular design and embodiments thereof, it will be understood that it is capable of the modification to achieve the objectives of this invention without departing from the invention disclosed.

Having thus described our invention, what we claim is:

1. An end cap for protecting and supporting a roll of material having a core around which the material is wrapped, a roll being supported with its axis vertical by a pair of end caps facing each other, one on each end respectively of the roll and each end cap comprising:

a one-piece sheet of material pre-formed of molded pulp;

said sheet having an outside wall formed with depressions which create an inside wall having raised rib roll support areas;

a plug at the center of the sheet extending from and beyond said inside wall and having a periphery which fits into the roll core;

a circular trough surrounding the plug and providing a space between the outside and inside walls of the end cap to receive an end of the core of the roll projecting beyond the material in the roll, the depth of said trough relative to the projection of said core being such that the end of the material in the roll engages the inside wall of the cap, a collar on said sheet extending toward the roll beyond said inside wall surrounding said plug and forming therewith a chamber to receive one end of the roll;

said depressions in said outside wall extending from said collar inwardly whereby straps can be received in the depressions for attaching each end cap to the roll and to the other end cap.

2. An end cap as recited in claim 1 wherein said collar has two pairs of walls, a first pair being parallel to each other on opposite sides respectively of said plug and a second pair being parallel to each other on opposite sides of said plug and perpendicular to said first pair of walls.

3. An end cap as recited in claim 2 wherein said rib support areas are angularly spaced from each other around said plug and the depressions forming each support area having a pair of legs, one leg being perpendicular to one of said first pair of walls of said collar and another leg perpendicular to said second pair of walls of the collar.

4. An end cap as recited in claim 3 wherein said legs of each pair are connected at inner ends spaced from said collar by a depression forming an arm extending diagonally relative to the legs.

5. An end cap as recited in claim 4 wherein the legs of each pair of legs extend at right angles to each other and said connecting arm is radial relative to the center of said plug.

6. An end cap as recited in claim 5 wherein there are four roll support areas around said plug angularly spaced ninety degrees relative to each other.

7. An end cap as recited in claim 6 wherein one leg of each support area is in the same plane as one leg in another support area, said plane being outside said plug, and said arm of each support area being in the same plane as the area of another support area and in a plane through said plug.

* * * * *